United States Patent [19]

Konishi et al.

[11] Patent Number: 4,757,286

[45] Date of Patent: Jul. 12, 1988

[54] MICROWAVE FILTER DEVICE

[75] Inventors: Yoshihiro Konishi, Sagamihara; Kenichi Konno, Machida, both of Japan

[73] Assignee: Uniden Corporation, Ichikawa, Japan

[21] Appl. No.: 54,504

[22] Filed: May 27, 1987

[30] Foreign Application Priority Data

Jul. 4, 1986 [JP] Japan ..... 61-156154

[51] Int. Cl.[4] ..... H01P 1/203; H01P 7/08

[52] U.S. Cl. ..... 333/204; 333/205; 333/235

[58] Field of Search ..... 333/204, 205, 156, 161, 333/219, 235, 246, 222–224, 245, 203, 115–116

[56] References Cited

U.S. PATENT DOCUMENTS

| | | | |
|---|---|---|---|
| 3,656,179 | 4/1972 | De Loach | 333/161 |
| 4,160,220 | 7/1979 | Stachejko | 333/161 |
| 4,288,766 | 9/1981 | Okita | 333/246 X |
| 4,429,289 | 1/1984 | Higgins, Jr. et al. | 333/246 X |
| 4,488,131 | 12/1984 | Griffin et al. | 333/205 |

*Primary Examiner*—Marvin L. Nussbaum

*Attorney, Agent, or Firm*—Oblon, Fisher, Spivak, McClelland & Maier

[57] ABSTRACT

A microwave filter having a filtering effect against specific frequencies is fabricated by erecting a second dielectric substrate on the upper surface of a first dielectric substrate, a resonating circuit is formed by locating strip lines facing towards each other on both surfaces of this second dielectric substrate, and the strip lines are connected to input and output lines on the first dielectric substrate.

7 Claims, 7 Drawing Sheets

MICROWAVE FILTER DEVICE

BACKGROUND OF THE INVENTION

The present invention relates to filter devices used in the microwave region, and particularly to improvements of microwave filter devices consisting of strip lines.

In circuit systems processing microwave signals, filter devices such as band-pass filters (BPF) or band-rejection filters (BRF) are important circuit elements. Along with the recent trend aiming toward lighter-weight, smaller-size electronic equipment, there has been an enhanced need in particular for filter devices using conductor lines and strip lines which can be mounted on the same circuit board with the circuit parts.

Various types of microwave filter devices using such strip lines have been developed in the past. Typically, they can be summarized in those illustrated in FIGS. 1–5.

The microwave filter device 10 illustrated in FIG. 1 is generally called a half-wave distributed-coupling type band-pass filter (BPF). Between its input line 11 and output line 12 it has resonator lines 13, 14 arranged next to each other on two-dimensional planes, displaced from each other by the equivalent of a quarter wavelength, and separated from each other by distributed coupling gaps 15, 16, 17.

The microwave filter device 20 illustrated in FIG. 2, although of the same distributed-coupling type, is a BPF device of the type called the quarter-wavelength type. The resonator lines 23, 24 are arranged next to each other between the input line 21 and output line 22 and are separated from each other by distributed coupling gaps 25, 26, 27. Their lengths are both set to equal a quarter wavelength, and they are each grounded at the opposite ends. This BPF device 20 is also called the interdigital type.

The microwave filter device 30 illustrated in FIG. 3 is a BPF device of the type called the tip-coupled type. One end of the first resonator line 33, which has a length equivalent to a half wavelength, faces towards the tip of the input line 31, from which it is separated by a gap 35 for capacitive coupling. One end of the second resonator line 34, which also has a length equivalent to a half wavelength, faces towards the other end of the first resonator line 33, from which it is likewise separated by a gap 36 for capacitive coupling; and one end of the output line faces towards the other end of the second resonator line 34, similarly separated from it by a gap 37 for capacitive coupling.

Unlike the distributed-coupling type in which the lines are separated by a number of gaps, as described above, there are microwave filter devices using quarter-wavelength lines such as those shown in FIGS. 4 and 5 which are composed of strip lines which are connected completely ohmically with respect to direct current.

The one shown in FIG. 4 is a microwave band-pass filter device 40 of a type called the quarter-wavelength line-coupled type. Its resonator lines 45, 46, 47, each having a length equivalent to a half wavelength, are arranged orthogonally towards its input and output lines 41, 42 and towards the connecting parts between them, which are coupling lines 43, 44 each having a length equivalent to a quarter wavelength.

The microwave filter device 50 shown in FIG. 5 is a band-rejection filter (BRF) device in which the resonator lines 54, 55, which each have lengths equivalent to a quarter wavelength, are formed orthogonally towards the coupling line 53, which couples the input and output lines 51, 52 and has a length equivalent to a quarter wavelength, and towards the connecting parts with each of the input and output lines.

These conventional microwave filter devices 10–50 are each configured on two-dimensional planes on dielectric substrates. In most cases, the dielectric substrates are printed circuit boards which mount the filter devices together with their peripheral circuits.

As described above, there have been various types of microwave filter devices using conductor lines in the past. However, a common characteristic of all of them is the fact that their various lines are formed by patterning on two-dimensional planes on a single dielectric substrate. They are generally formed by etching on dielectric substrates (printed circuit boards) having copper foil surfaces.

However, these physical common structures used in the past actually have a large drawback. That is, filter devices of this type require a rather large space.

In concrete terms, let us assume, for example, that the conventional filter devices 10–50 illustrated in FIGS. 1–5 are designed for use with microwaves of the 1 GHz band. In this case, a quarter wavelength of the 1 GHz band will be at least 3 to 4 cm or longer. Thus, if for the sake of convenience the length of the filter device is made equivalent to the distance between the signal input terminal and output terminal and the device's width is made equivalent to the width in the direction orthogonal to that length, even the interdigital type BPF device 20 illustrated in FIG. 2 or the BRF device 50 illustrated in FIG. 5, which had the shortest lengths of those given thus far, will require a length of at least the order given above. The other filter devices will require lengths equal to about double or four times this length. That is, the required lengths will range from at least about 10 cm or less to nearly 20 cm at most.

Even the filters 20, 50 illustrated in FIGS. 2 and 5, which require lengths equivalent to only about a quarter wavelength, as described above, require additional area in the width direction to position the lines side by side, or similarly require dimensions equivalent to about a quarter of the wavelength for the resonator lines which are orthogonal to them.

Regions with such areas are quite large. For example, in electronic equipment handling microwaves such as radar detectors or satellite broadcast receivers, the substrates required for all circuits other than the filter devices require at the most dimensions of 10 cm or less even on their long sides. In comparison with them, one can understand what a large area is occupied by these conventional filter devices, which are only a single circuit element.

In actual fact, the size of the area occupied by these recent filter devices has been an extremely large obstacle to miniaturization of electronic circuit systems using them.

Incidentally, the interdigital type BPF device illustrated in FIG. 2, which is designed with a relatively small size, has a different drawback. That is, it requires additional patterning at the alternating ends of the input and output lines 11, 12 and the resonator lines 13, 14, or through-hole processing at numerous places, in order to give them electrical continuity with the grounding surface. This results in the inconvenience of increased complexity of the structure.

The following is another problem which is common to all the conventional microwave filter devices. That is, it is desirable to increase as much as possible the resonance coefficient Q of the dielectric substrates on which the strip lines are mounted, in order to suppress to a minimum the insertion loss of filters of this type. Nevertheless, in the actual products, which are electronic equipment, other elements must be taken into consideration when designing matters such as the materials of their substrates, rather than making their structural designs solely for the purpose of satisfying the electrical performance required in the filter devices. For this reason, there are restrictions on the substrate materials which can be used.

For example, in actual circuit designs, the printed circuit boards which serve also as the supporting substrates for the other peripheral circuit systems are substituted as the dielectric substrates of the conventional examples described above. That is, the strip line patterns which are needed for these filter devices are also formed at the same time as the conductive patterns for the other circuit elements are formed on the printed circuit boards.

Therefore, even though it is desirable for the filter devices themselves to use a substrate made of an expensive material such as Teflon which has a high Q value, nevertheless, it would be too wasteful, simply for the sake of the filter devices alone, to use such a high-quality material as Teflon in the substrate for the other circuit element parts as well. On the contrary, since the supreme requirement in general is reducing the costs, it was necessary to use materials which offered a tradeoff between the performance and costs of printed circuit boards. At the best, materials such as glass epoxy or paper phenol were used.

SUMMARY OF THE INVENTION

The present invention was made in view of the drawbacks of the past described above. Its object is to provide a microwave filter device in which it will be possible to reduce the area occupied in terms of two-dimensional planes, which is simple to fabricate, and in which the electrical charateristics will not be damaged, but can even be improved if needed.

To attain the above object, the microwave filter device of this invention comprises a first dielectric substrate on which the input and output lines are formed; a second dielectric substrate which is erected so as to stand up on the first dielectric substrate; and a resonating circuit which is formed on the surface of the second dielectric substrate and which is connected electrically to the input and output lines.

In many cases the dielectric substrate supporting the input and output lines and the resonating circuit is a separate substrate, and the input and output lines are connected electrically with the other peripheral circuits. Therefore, even if the filter device of this invention is formed on the first dielectric substrate, which consists of a printed circuit board on which the other peripheral circuits are mounted, it is possible to achieve a reduction of the two-dimensional space occupied by it on the first dielectric substrate by forming the resonating circuit on the second dielectric substrate, which can be made of any material having good properties as dielectrics, and by erecting the second dielectric substrate so as to stand up on the first dielectric substrate.

The chief resonator parts which play a role in the filtering of the microwave filter device are formed on the second dielectric substrate, which is independent of the first dielectric substrate and which also stands erect on it.

When this is done, it is possible to reduce greatly the area it occupies in terms of two-dimensional planes as compared with any of the conventional examples illustrated in FIGS. 1–5, which essentially must occupy a large area.

Any desired method may be adopted for erecting the second dielectric substrate. That is, the second dielectric substrate may have any angle with respect to the first dielectric substrate. However, the most common method is to erect the former vertically with respect to the latter. Such a vertical arrangement will also allow this invention to display its greatest effect in reducing the area occupied.

From the standpoint of the physical structure as well, erecting the second dielectric substrate to stand up on the first substrate does not involve any very great technical difficulties. Moreover, the input and output lines formed on the first dielectric substrate can be connected easily to the resonating circuit formed by patterning on the second dielectric substrate. These connections can be made by means of existing technologies such as soldering.

Consequently, the goal of simplicity of fabrication can also be achieved, since none of the structural complexities involved in miniaturization such as those which were observed in the microwave filter devices of the past are required, and also since no large changes are required in the existing printed wiring technologies.

In addition, there is a large degree of freedom in electrical designing, and it is easy to design devices having any resonance modes or required bands. Devices with a low loss can also be obtained relatively easily.

The fact that the material of the second dielectric substrate is not constrained by the material of the first dielectric substrate is extremely advantageous, especially in attaining a low loss.

That is, the loss can be lowered as necessary by selecting a material having any desired Q value and any plate thickness for the second dielectric substrate. Even if expensive materials with a high Q value such as Teflon are selected, it is possible to use inexpensive materials in the larger first dielectric substrate, on which the other peripheral circuit systems are mounted. This makes it possible to keep the cost of the product as a whole inexpensive. In fact, thanks to the various secondary effects accompanying miniaturization, it is possible to make it even more inexpensive than the products of the past.

Additional objects and characteristics of this invention will be clarified in the detailed description below based on the attached drawings.

FIGS. (A) through 7(C), 8(A), 8(B), 9(A) through 9(C), 10(A) and 10(A) are schematic drawings of other embodiments of this invention.

DETAILED DESCRIPTION OF THE PREFERRED EMBODIMENT

A double-tuned band-pass filter device 100 is shown in FIG. 6 as the basic first embodiment of a microwave filter device configured in accordance with this invention.

Figure 1:
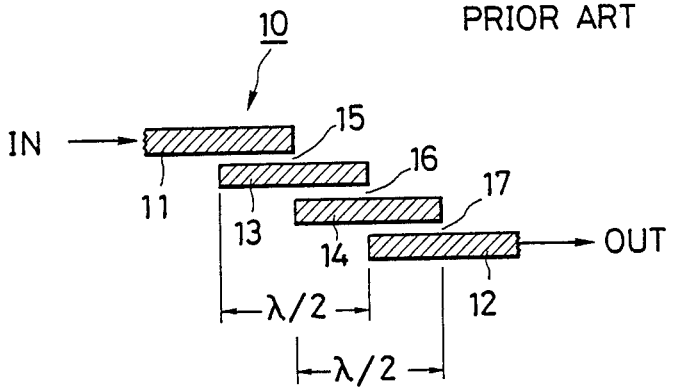
FIG. 1 PRIOR ART
FIGS. 1 through 5 are schematic drawings of the configurations of various microwave filter devices of the past.
Figure 2:
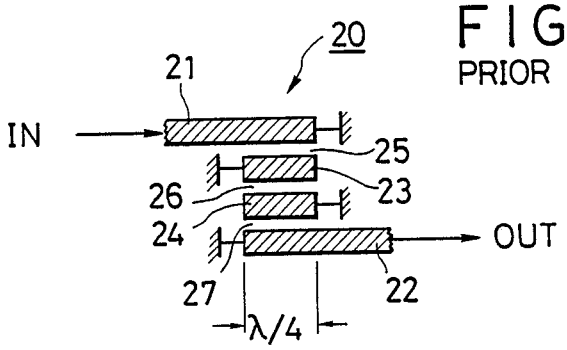
FIG. 2 PRIOR ART
Figure 3:
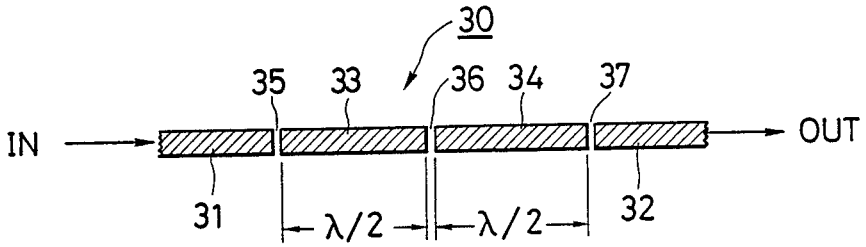
FIG. 3 PRIOR ART
Figure 4:
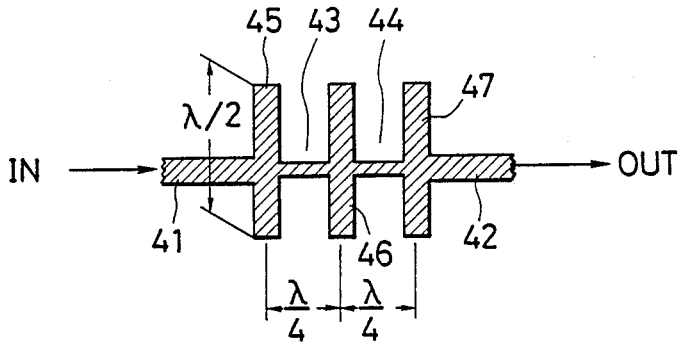
FIG. 4 PRIOR ART
Figure 5:
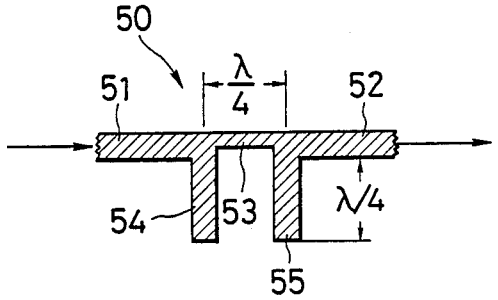
FIG. 5 PRIOR ART
Figure 6A:
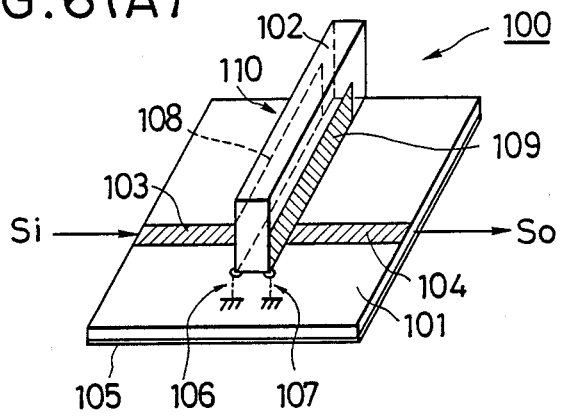
FIGS. 6(A) through 6(D) illustrate the configuration and action of a first embodiment of the invention.

A first dielectric substrate 101 and a second dielectric substrate 102 are used in this invention. In this embodiment as well, as shown in FIG. 6(A), the second dielectric substrate 102 is a separate component which is erected so as to stand up on the first dielectric substrate 101. It stands up in a vertical position, as is shown in the drawing.

The input line 103 and output line 104 of the microwave signals are formed on the first dielectric substrate 101 as strip lines by patterning by means of ordinary etching. A conductive surface 105 is also formed on its rear surface.

This conductive surface 105, as is clear from what is described below, does not necessarily need to be provided over the entire rear surface. It is enough if it includes at least the region where this filter device 100 is located and is in the vicinity of its periphery.

Figure 6B:
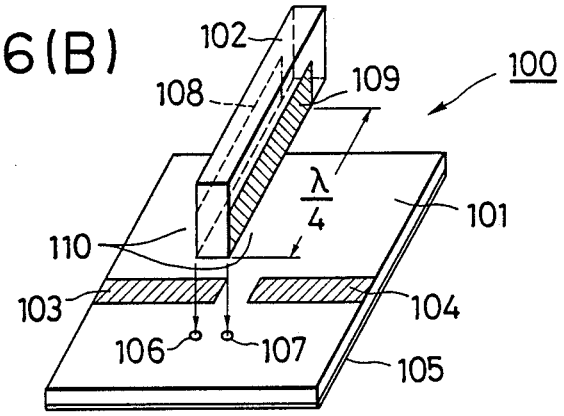

As is shown in FIG. 6(B), through-holes 106, 107 are formed on the first dielectric substrate 101. The edges of these through-holes 106, 107 at the substrate surface part are conductive edges connected electrically to the conductive surface 105 on the rear surface. Naturally, conductive dot patterns may also be formed around the circumferences of the surface outlets of these through-holes 106, 107, although this is not shown in the drawings.

On the other hand, strip lines 108, 109, which have a length corresponding to approximately a quarter wavelength with respect to the wavelength $\lambda$ of the central frequency of the target frequency band, are formed with a predetermined width (length in the height direction) along the bottom edges of both main surfaces of the second dielectric substrate 102. They also are formed by the same patterning method as the wiring on ordinary printed circuit boards. Their lower edges at one end are connected to the outlet conductive edges of the through-holes 106, 107 which are exposed on the surface of the first dielectric substrate, thereby bringing them into connection with the conductive surface 105 on the rear surface of the first dielectric substrate.

The strip lines 108, 109 are connected electrically to the input and output lines 103, 104 at a predetermined distance away from this equivalent grounding terminal, and a resonating circuit 20 is thus formed on the second dielectric substrate 102.

The means for electrically connecting the strip lines 108, 109 on both surfaces of the second dielectric board 102 and their corresponding input and output lines 103, 104 and for connecting them electrically to the through-holes 106, 107 may be means such as ordinary soldering, but conductive adhesive agents or the like may also be used.

As is clear from the foregoing, it is not necessary to use a fixing means for fastening the second dielectric substrate 102 to the first dielectric substrate 101. However, it would be convenient if it were possible to fasten the second dielectric substrate 102 temporarily when it was standing erect on the first dielectric substrate 101 before soldering. Temporary holding of this type can be performed with a simple configuration by forming a protrusion, not shown in the drawings, on one or both ends of the second dielectric substrate 102. This protrusion can be inserted rather forcibly into a hole which is provided in the first dielectric substrate 101 and which also serves for positioning in the prescribed position.

In the configuration illustrated in FIG. 6(A), the microwave input signals Si supplied to the input line 103 pass through the input line 103 and excite the first quarter-wavelength strip line 108 formed on the second dielectric substrate 102.

The first quarter-wavelength strip line 108 is connected by a distributed coupling to the second strip line 109, which faces it on the other side of the second dielectric substrate 102. Therefore, the input microwave signals Si undergo the expected filtering by the double-tuned resonating circuit 20 formed by these first and second strip lines 108, 109 and are outputted from the output line 104 as output signals So.

Figure 6C:
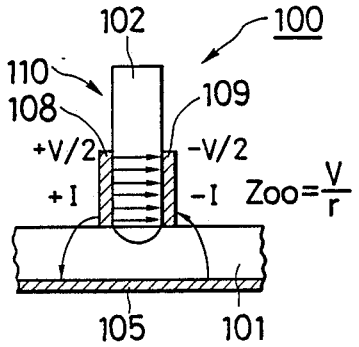
Figure 6D:
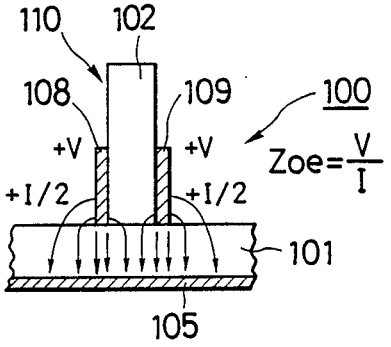

To explain this action in somewhat greater detail, the pair of strip lines 108, 109 formed on the second dielectric substrate in the structure of this embodiment have a distributed coupling relationship, as mentioned above. Therefore, the distribution of the lines of electric force will be as shown in FIG. 6(C) in the odd mode and as shown in FIG. 6(D) in the even mode. Thus, if the circuit characteristic impedances in the odd and even modes are Zoo and Zoe, respectively, it will be easy to make Zoo much less than Zoe, as is clear from the relationship shown in the drawings.

Consequently, it is clear that BPF devices using the configuration of this embodiment can take a quite broad bandwidth, since the coupling coefficient, $\beta$ is determined, as is well known, by $$\beta=(Zoe-Zoo)/(Zoe+Zoo)$$

Naturally, as was mentioned above, if such a configuration is used, a first dielectric substrate 101 which is inexpensive and inferior in its characteristics may be used. That is, as is seen in existing electronic equipment, even if a cheap material such as paper phenol is used, as in the past, for the printed circuit board on which almost all of the circuit systems are chiefly mounted, if this invention is used, a material of desirable characteristics can be selected for the second dielectric substrate. This makes it possible to obtain superior filter devices with a low loss. Moreover, the second dielectric substrate can be erected standing up preferably in vertical position towards the first dielectric substrate. Therefore, the circuitry can utilize space with an increased efficiency, and the two-dimensional space occupied by it can be reduced considerably.

Figure 7A:
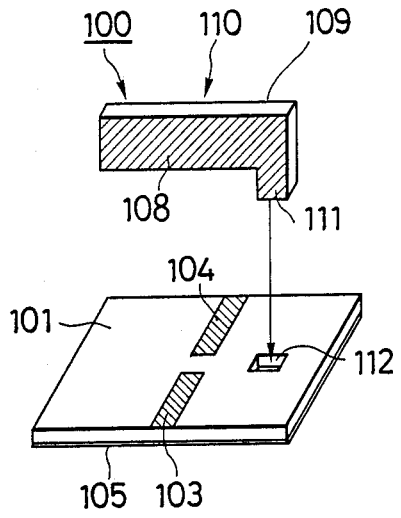

In the embodiment illustrated in FIG. 7, the mechanism connected with filtering may be thought of in the same way as in the first embodiment, but it has been given a configuration which is even more convenient for actual fabrication.

That is, a single dielectric substrate with a large area and with copper foil attached all over both of its surfaces has been selected as the material for the second dielectric substrate 102, as is seen in the source boards for ordinary printed circuit boards. A resonating circuit 20 containing the first and second strip lines 108, 109 of predetermined areas is then obtained by simple cutting from it.

Moreover, the embodiment has been given the temporary holding function which was described above, and it is also possible to omit the process of forming through-holes used in the first embodiment.

To describe this in detail, when the dielectric substrate with conductive surfaces made of copper foil or the like formed all over both its surfaces, as mentioned above, is cut out to have the area necessary for the first and second strip lines 108, 109, it is cut out so that, in addition to these strip lines, it will be possible to form at the same time a leg 111 extending downward on one of its ends. A rectangular hole 112, preferably of a size making it possible for this leg 111 to pass through it tightly, is also formed at a corresponding position on the first dielectric substrate 101.

If the leg 111 of the second dielectric substrate 102 is pushed into the corresponding hole 112 on the first dielectric substrate 101, it will be possible to hold the second dielectric substrate 102 temporarily on the first dielectric substrate 101, and it will be easier to carry out the connecting work such as the soldering of the input and output lines 103, 104 on the surface of the first dielectric substrate with the strip lines 108, 109 in the resonating circuit corresponding to them. In addition, if the leg 111 is given a suitable length, on the conductive surfaces on both surfaces of the leg part protruding on the rear surface of the first dielectric substrate it will be possible to carry out easily the grounding work of the strip lines 108, 109, by means of soldering 113, 114 with the conductive surface 105 on the rear of the first dielectric substrate, as is shown in FIG. 7(C).

The fact that it is possible to obtain the shapes of the second dielectric substrate and the resonating circuit 20 in this way by cutting alone has a structural effect, in that there will be no waste at all in the dimensions of the second dielectric substrate 102 in the height direction. In addition, fine adjustment of the desired filter characteristics will also be easy. For instance, the central frequency of the filter can be increased by merely adjusting the open end of the quarter-wavelength strip lines by cutting it suitably. On the contrary, the central frequency of the filter can be lowered by merely adjusting their grounding side by cutting.

Figure 7B:
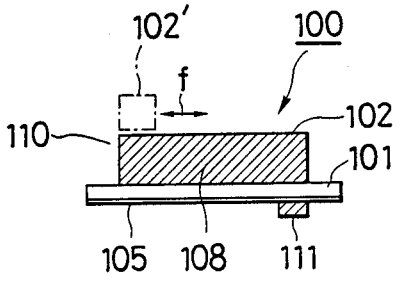
Figure 7C:
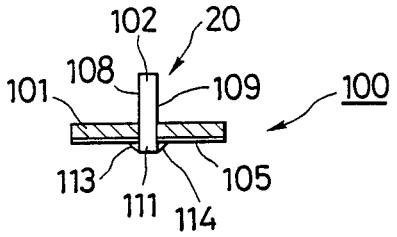

In addition, if a small piece 102' of dielectric material is rested on the second dielectric substrate 102, as is shown by the imaginary lines in FIG. 7(B), and slid along as shown by arrow f, the central frequency will change continuously and will become lower as it is moved from the short-circuit side to the open side. This can also be used to make fine adjustments simply of the central frequency of this BPF device 100.

Figure 8A:
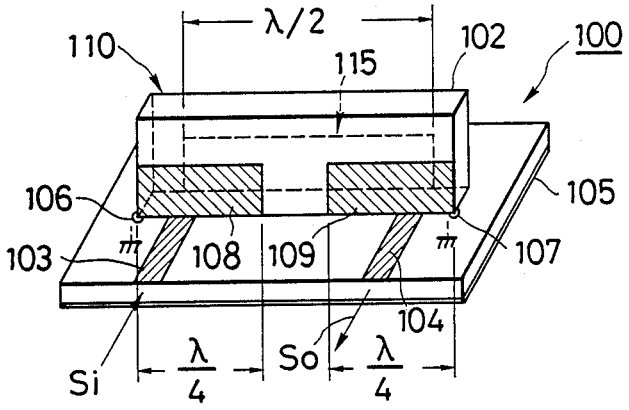
Figure 8B:
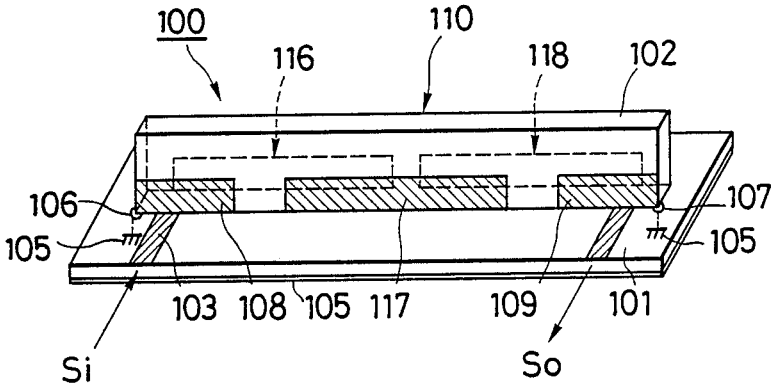

FIG. 8 shows the configurations of multistage BPF devices which are other embodiments of this invention. FIG. 8(A) shows a three-stage BPF device, and FIG. 8(B) a five-stage BPF device. Since the filters in both embodiments have odd numbers of stages, both the input and output lines 103, 104 formed on the first dielectric substrate 101 are positioned on the same side with respect to the second dielectric substrate 102.

To begin our explanation with FIG. 8(A), the input line 103 is connected to the first quarter-wavelength strip line 108, which is located at one end of one side of the second dielectric substrate 102. The output line 104 is also on the same side of the second dielectric substrate 102 but is connected to the second quarter-wavelength strip line, which is located at the other end.

The first and second strip lines 108, 109 are connected electrically to the conductive surface 105 on the rear side of the first dielectric substrate 101, either by means of through-holes 106, 107 in the same way as in the embodiment described above, or by a method such as that used in the embodiment illustrated in FIG. 7.

On the other hand, a half-wavelength strip line 115 is formed on the other side of the second dielectric substrate 102. It is located so that it will overlap the first and second quarter-wavelength strip lines 108, 109 so as to cover a space equal to more or less a quarter wavelength of each of them.

Therefore, if the distance selected between the first and second quarter-wavelength strip lines 108, 109 which are adjacent to each other on one side of the second dielectric substrate is insufficient for coupling them, it will prevent direct coupling between them, and they will have coupling via the half-wavelength strip line 115. Thus, the desired three-stage filter can be realized.

As is clear from these considerations, the five-stage filter shown in FIG. 8(B) will have three half-wavelength strip lines (116, 117, 118) installed midway. The strip line 117 at the middle is on both surfaces of the second dielectric substrate 102 and can be thought of in the same way as that shown in FIG. 8(A) as far as its filter operations are concerned, except for the fact that it comes on the same side as the first and second quarter-wavelength strip lines 108, 109.

Naturally, this embodiment can be generalized further and developed to n stages. In cases where a filter device is configured with an even number of stages, the lead-out direction of the input and output lines will be different from that shown in FIG. 8. The lines will lead out in opposite directions, with the second dielectric substrate 12 between them.

However, it is possible to introduce penetrating conductive path technologies such as through-hole technologies into the second dielectric substrate. If this is done, the length of one or the other of the half-wavelength strip lines can be reduced to about half, and they can be formed on the surfaces of the second dielectric substrate 102. Their adjacent end parts can be coupled to each other across the thick part of the second dielectric substrate by means of such conductive paths. In this case, the lead-out directions of the input and output lines can be reversed both when there is an odd number of stages and when there is an even number.

In this invention, the resonating circuit 110 of the filter is formed on the second dielectric substrate 102, which is independent of the first dielectric substrate. Therefore, the configuration of this circuit is comparatively free. In most actual products, there is some extra space on the first dielectric substrate 101 in the height direction. Thus, filters of various forms can be obtained by making effective use of this extra space to form whatever conductor patterns are necessary.

Figure 9A:
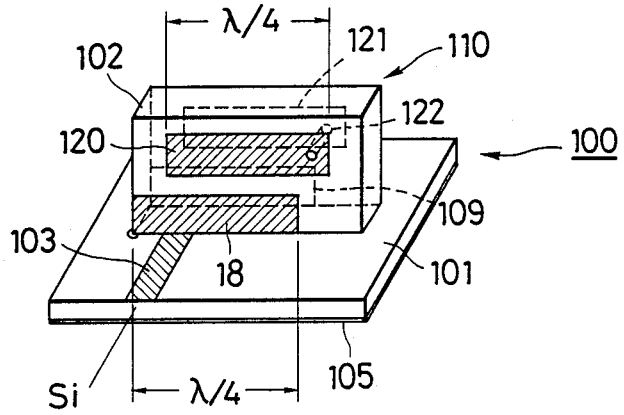
Figure 9B:
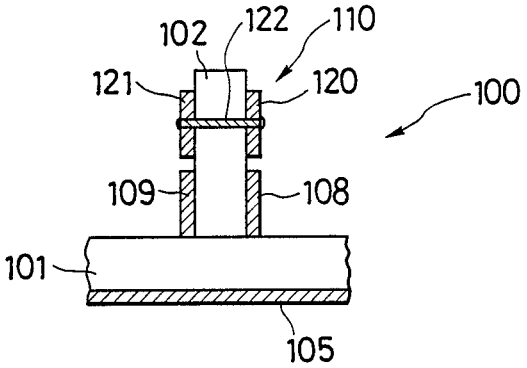
Figure 9C:
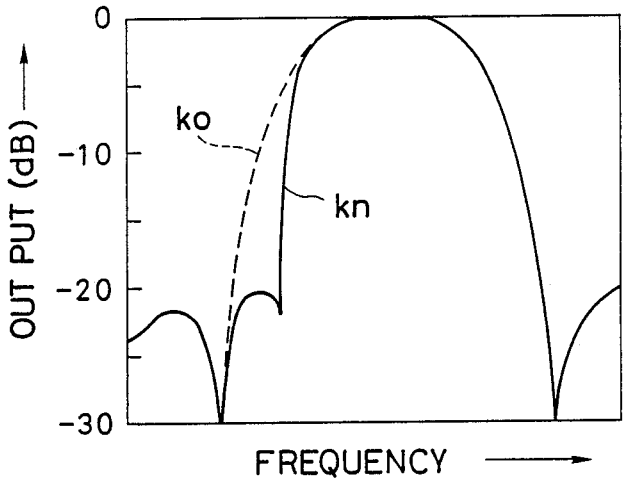

FIG. 9 shows a BPF device with notches, a somewhat special embodiment illustrating such a case.

In the configuration shown in FIG. 9(A), the relationship between the configuration of the lower half of the second dielectric substrate 102 and the configuration of the input and output lines 103, 104 on the first dielectric substrate 101 is roughly the same as in the configuration illustrated in FIGS. 6(A) and (B). That is, the first and second resonating strip lines 108, 109 are coupled by distributed coupling to the input and output lines 103, 104, and one end of each of them is connected to the conductive surface 105 on the rear of the first dielectric substrate by means of conductive paths such as through-holes 106, 107 or by the method shown in FIG. 7.

Consequently, if the configuration consisted of this alone, the device would display ordinary BPF characteristics, as is shown by curve Ko, marked by imaginary lines, in FIG. 6(C).

However, in the embodiment illustrated in FIG. 9, there are also on the second dielectric substrate 102 strip lines 120, 121, which each have lengths equivalent to more or less a quarter wavelength and which are coupled by distributed coupling to the upper edges of the first and second resonating strip lines 108, 109. These quarter-wavelength strip lines 120, 121 are connected to each other electrically at one of their ends by means of a conductive path 122 such as a through-hole or a conductive screw.

Consequently, the second set of quarter-wavelength strip lines 120, 121, viewed by themselves, together make up a half-wavelength resonator. However, they are coupled by distributed coupling to the main strip lines 108, 109, as described above. Therefore, the filter device shown in the drawings, when viewed as a whole, will have a notch kn, as is shown by the characteristic curve in FIG. 9(C). This notch resonating frequency can be varied within a certain range by adjusting the lengths of the strip lines 120, 121.

If this is done, the radiation loss will be less, and a higher Q value can be obtained than if one strip line were stretched out to a length equivalent to a half wavelength, since the half-wavelength strip lines added for the sake of notch resonance also have a folded structure of a quarter wavelength.

Thus one can understand that in this invention various types of resonating configurations can be designed because in most cases extra space in the height direction is provided in the second dielectric substrate which is erected so as to stand up on the first dielectric substrate. In some cases, a resonating circuit 101 can be realized by means of distributed couplings between line structures mounted centrally by means of capacitor or inductor elements mounted on the second dielectric substrate 102, instead of distributed couplings between lines.

Figure 10A:
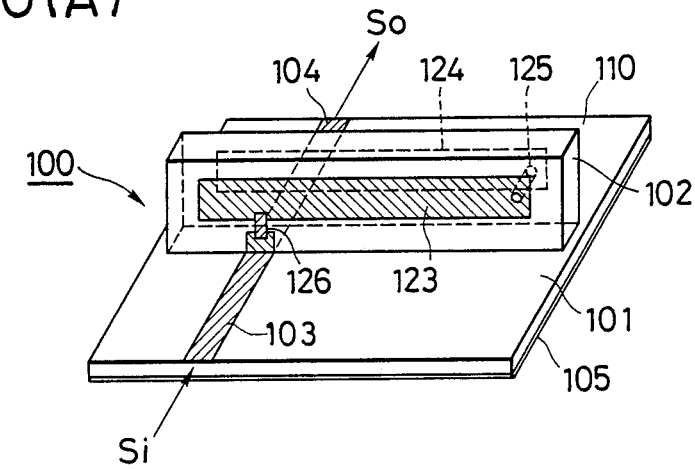
Figure 10B:
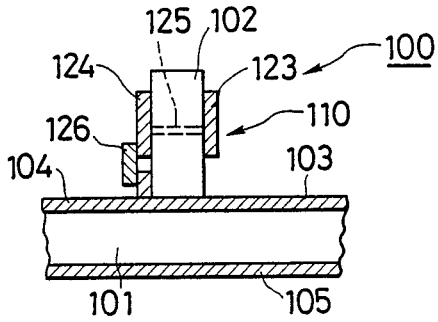

On the other hand, this invention can also be configured in the form of notch filter devices, which display sharp characteristics in removing specific frequencies. FIG. 10 illustrates a desirable embodiment in which such a notch filter device is configured.

In the embodiments described thus far, the input and output lines 103, 104 were separated from each other at their adjacent parts, but in this embodiment they are configured as a single continuous line on the first dielectric substrate 101.

The second dielectric substrate 102 straddles this continuous strip line (103, 104), and first and second strip lines 123, 124 are formed on both its sides.

The first and second strip lines 123, 124 each have a length equivalent to about a quarter wavelength, and are connected to each other at one of their ends by means of a conductive path 125 such as through-hole or conductive screw which penetrates through the second dielectric substrate 102. Therefore, this pair of quarter-wavelength lines 123, 124 facing towards each other together make up a half-wave folded resonator.

Connections between the input and output lines 103, 104 and the resonator structures 123, 124, 125 are effected at a suitable position by a suitable coupling element 126, which may be a capacitor with the shape of a chip part.

Clearly, such a structure can be created essentially merely by placing the structure of the second dielectric substrate, which has been fabricated separately, over a single signal circuit (103, 104).

In this embodiment also, the half-wavelength resonator has a folded configuration at quarter wavelengths, just as in the embodiment illustrated in FIG. 9 above. Therefore, it has little radiation loss, and a high Q value can be attained. In other words, both these embodiments illustrated in FIGS. 9 and 10 can satisfy both requirements for miniaturization and for high performance.

As is clear throughout all of the embodiments described above, considerations of the materials which can be used are especially effective in this invention. That is, even in cases where the first dielectric substrate 101 must be made of a specific material for use as a printed circuit board mounting the other peripheral circuit systems (for example, when the first dielectric substrate 101 must be made of a material such as paper phenol)—and it is believed that this is so in most cases—there still remains the second dielectric substrate 102 for selecting the other design condition, and it can be made of any material desired. For example, in cases where a high Q value is required, one may select a material such as Teflon. Even when Teflon is selected, since the dimensions of the second dielectric substrate 102 are not very large, the costs will be less expensive than in cases where such an expensive material is used in all the substrates mounting the other peripheral circuit systems, and one can obtain the benefit of the superior performance properties alone.

Moreover, the fabricating methods needed for obtaining this effect are extremely simple. No special technologies are needed at all, and the methods can be reduced simply to assembling the substrates and soldering them together.

Furthermore, the two-dimensional area occupied can be greatly reduced, and this is in accordance with the recent trend towards ultra-miniaturization of various types of electronic equipment.

In addition, a number of the characteristic component parts of each of the embodiments described above can also be combined together if required to make up new embodiments of this invention.

What is claimed is:

1. A microwave filter device comprising a first dielectric substrate provided on its one surface with an input line and an output line for microwave signals; a second dielectric substrate which is erected so as to stand up on the first dielectric substrate; and a resonating circuit formed of at least two resonating strip lines formed one on either surface of the second dielectric substrate, one of said resonating strip lines being electrically connected to said input line and the other resonating strip line being electrically connected to said output line, and said resonating strip lines having a length substantially equal to a quarter wavelength of the center frequency of the frequency band used.

2. The microwave filter device or claim 1 in which first and second quarter-wavelength strip lines are located next to each other on one surface of the second dielectric substrate; the resonating circuit is composed by forming a half-wavelength strip line on the other surface of the second dielectric substrate so as to face towards said first and second quarter-wavelength strip lines; the first quarter-wavelength strip line is connected to the input line of the first dielectric substrate; and the second quarter-wavelength strip line is connected to the output line of the first dielectric substrate.

3. The microwave filter device of claim 1 in which first and second quarter-wavelength strip lines are located next to each other on one surface of the second dielectric substrate; n half-wavelength strip lines are located next to each other between these quarter-wavelength strip lines; the resonating circuit is composed by forming n+1 half-wavelength strip lines on the other side of the second dielectric substrate so as to face towards said first and second quarter-wavelength strip lines; the first quarter-wavelength strip line is connected to the input line of the first dielectric substrate; and the second quarter-wavelength strip line is connected to the output line of the first dielectric substrate.

4. The microwave filter device of claim 1 in which one of the resonating strip lines making up the resonating circuit on the second dielectric substrate is short-circuited, so that it will have a short-circuited side and an open side; and a small dielectric piece which can slide along the edge of the second dielectric substrate is provided, thereby to allow the central frequency to be varied by sliding the small dielectric piece between the open side and the short-circuited side of said quarter-wavelength strip line.

5. The microwave filter device of claim 1 in which the resonating circuit is given characteristics having a notch resonating frequency by providing distributed-coupling strip lines electrically connected to each other on both sides at the top of said resonating strip lines on the second dielectric substrate.

6. The microwave filter device of claim 1 further comprising a conductive surface formed on at least part of one surface of the first dielectric substrate.

7. The microwave filter device of claim 6 in which through-holes or apertures are provided in the first dielectric substrate; and the resonating strip lines on the second dielectric substrate are electrically connected through said through-holes or apertures to the conductive surface on the rear surface of the first dielectric substrate.

* * * * *